US007361095B2

(12) United States Patent
Michelau et al.

(10) Patent No.: US 7,361,095 B2
(45) Date of Patent: Apr. 22, 2008

(54) ROCKING HORSE STAND

(75) Inventors: Frederick Michelau, Des Plaines, IL (US); Thomas Schlegel, Wheaton, IL (US)

(73) Assignee: Radio Flyer Inc., Chicago, IL (US)

( * ) Notice: Subject to any disclaimer, the term of this patent is extended or adjusted under 35 U.S.C. 154(b) by 0 days.

(21) Appl. No.: 11/411,765

(22) Filed: Apr. 26, 2006

(65) Prior Publication Data

US 2006/0243458 A1 Nov. 2, 2006

Related U.S. Application Data

(60) Provisional application No. 60/675,125, filed on Apr. 26, 2005.

(51) Int. Cl.
*A63G 13/08* (2006.01)

(52) U.S. Cl. ..... 472/103; 472/105; 248/610

(58) Field of Classification Search ..... 472/97–105, 472/118–125; 248/610, 576
See application file for complete search history.

(56) References Cited

U.S. PATENT DOCUMENTS

| | | | | | |
|---|---|---|---|---|---|
| 2,437,015 | A | * | 3/1948 | Baltz | 472/105 |
| 2,891,792 | A | * | 6/1959 | Thoeming | 472/105 |
| 3,155,390 | A | * | 11/1964 | Moore et al. | 472/99 |
| 3,406,934 | A | * | 10/1968 | Grudoski | 248/593 |
| 4,693,466 | A | * | 9/1987 | Swengel, Sr. | 472/105 |
| 5,645,489 | A | * | 7/1997 | Laiche et al. | 472/103 |
| 5,700,201 | A | * | 12/1997 | Bellows et al. | 472/103 |

* cited by examiner

*Primary Examiner*—Kien Nguyen
(74) *Attorney, Agent, or Firm*—DLA Piper US LLP; R. Blake Johnston

(57) ABSTRACT

A stand for a rocking horse or other toy includes a plurality of legs, each with a top end and a bottom end. A foot is attached to the bottom end of each leg. Each foot has a top end, a bottom rim, and an outer wall defining an interior and generally extending from the top end to the bottom rim. The foot also has an interior sidewall defining a pocket with an opening in a vicinity of the top end for receiving the bottom end of a corresponding leg. Slots are also formed in the top end of each foot to receive braces running between the legs. The toy is suspended on the stand from the top ends of the legs so that it is permitted to rock relative to the stand.

18 Claims, 5 Drawing Sheets

ROCKING HORSE STAND

CLAIM OF PRIORITY

This application claims priority from U.S. Provisional Patent Application No. 60/675,125, filed Apr. 26, 2005.

BACKGROUND

The present invention is generally related to children's riding toys, and more particularly, to a stand for a rocking horse or other toy.

Rocking horses typically are supported on a stand with a vertical member at each one of the four corners of the stand. A helical spring extends from the top of each vertical member to a horse shaped body suspended by the springs in the middle of the stand. With this configuration, when a child is riding the horse, the springs permit the horse to rock back and forth. An example of such rocking horses is disclosed by U.S. Pat. No. 3,155,390 to Moore et al. This design, however, can be possibly become unstable due to a child causing excessive movement of the rocking horse and, in turn, the stand.

Thus, other known rocking horses have stands with extra brace members that lie across the floor providing a large base or contact area. Such rocking horse stands are disclosed by U.S. Pat. No. 5,645,489 to Lathe et al.; U.S. Pat. No. 3,406,934 to Grudoski; U.S. Pat. No. 2,891,792 to Thoeming; and U.S. Pat. No. 2,437,015 to Baltz. However, none of these rocking horses feature a stable design where only the feet of the rocking horse touch the floor.

Thus, it is an object of the present invention to provide an improved rocking horse stand that is stable, economical to produce and easy to assemble.

SUMMARY OF THE INVENTION

The present invention is directed to an easily assembled and stable rocking horse stand. More specifically, a rocking horse has a body adapted for being sat upon by a child, and a stand that includes a plurality of legs, each with a top end and a bottom end. A foot is positioned on the bottom of each leg. The foot has a top end, a bottom rim, and a generally cylindrical outer wall defining an interior and generally extending from the top end to the bottom rim. The foot also has an interior sidewall defining a pocket with an opening in a vicinity of the top end for receiving one bottom end of one of the legs within the interior of the outer wall. The body is suspended on the stand by springs connected between the horse body and the top ends of the legs so that the horse is permitted to rock relative to the stand. The stand has a number of brace members that extend from leg to leg. The top of each foot defines slots for receiving the corner brace pieces that are connected to the brace members.

The interior of each foot has a bottom wall, and each leg has a bottom end facing the bottom wall. The bottom wall defines an aperture and the bottom end of the corresponding leg has a threaded extension that passes through the aperture. A clamping device, such as a threaded base nut, is used for trapping the bottom wall between the bottom end of the leg and the nut. The nut is threaded to the extension on an exterior side of the bottom wall relative to the leg. While the bottom rim is also a base that touches the floor for supporting the stand, the base nut is sufficiently thick to sit on the floor as well.

DESCRIPTION OF THE PREFERRED EMBODIMENTS

Figure 1:
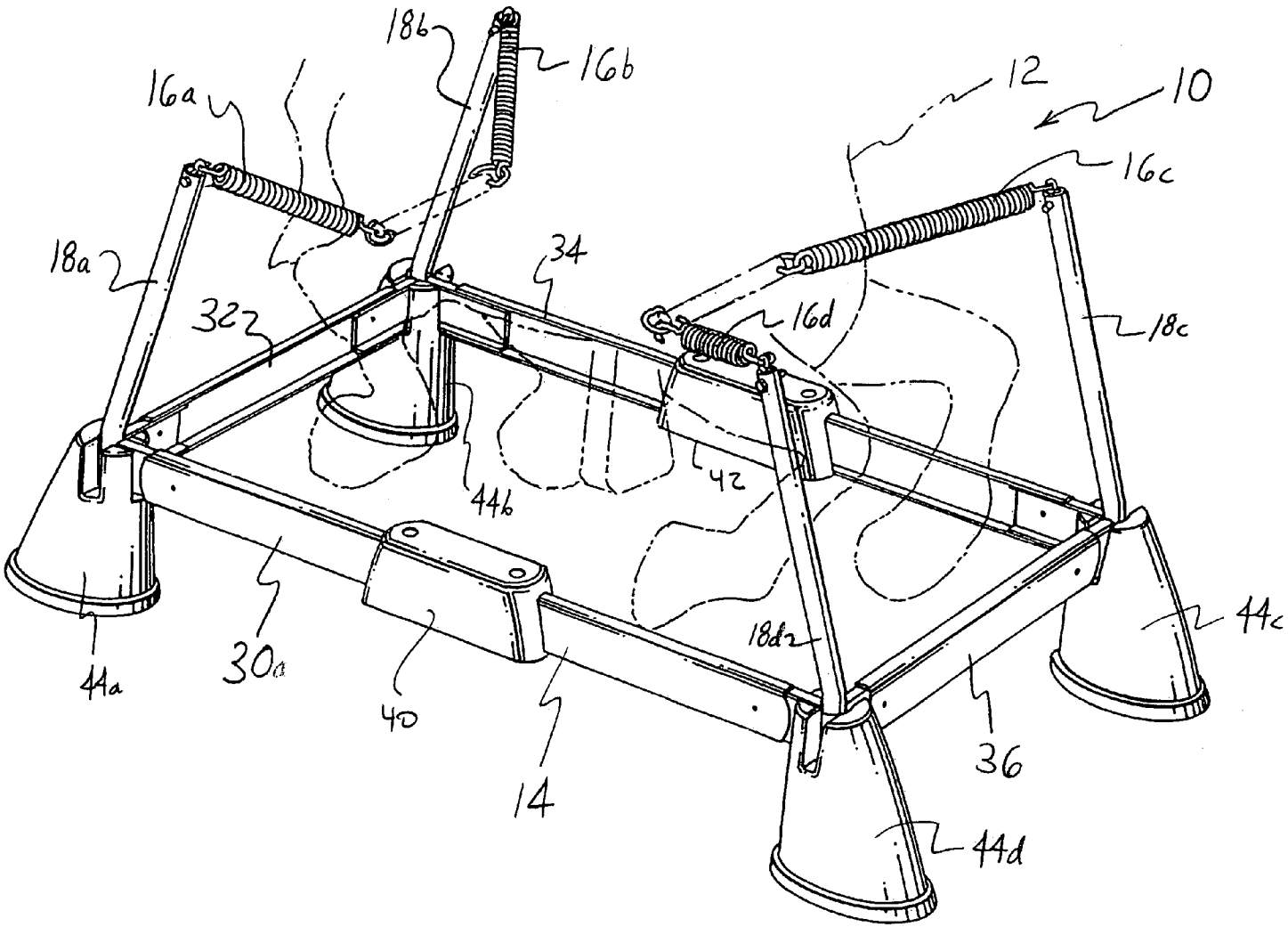
FIG. 1 is a perspective view of an embodiment of the rocking horse stand of the present invention.
Figure 2:
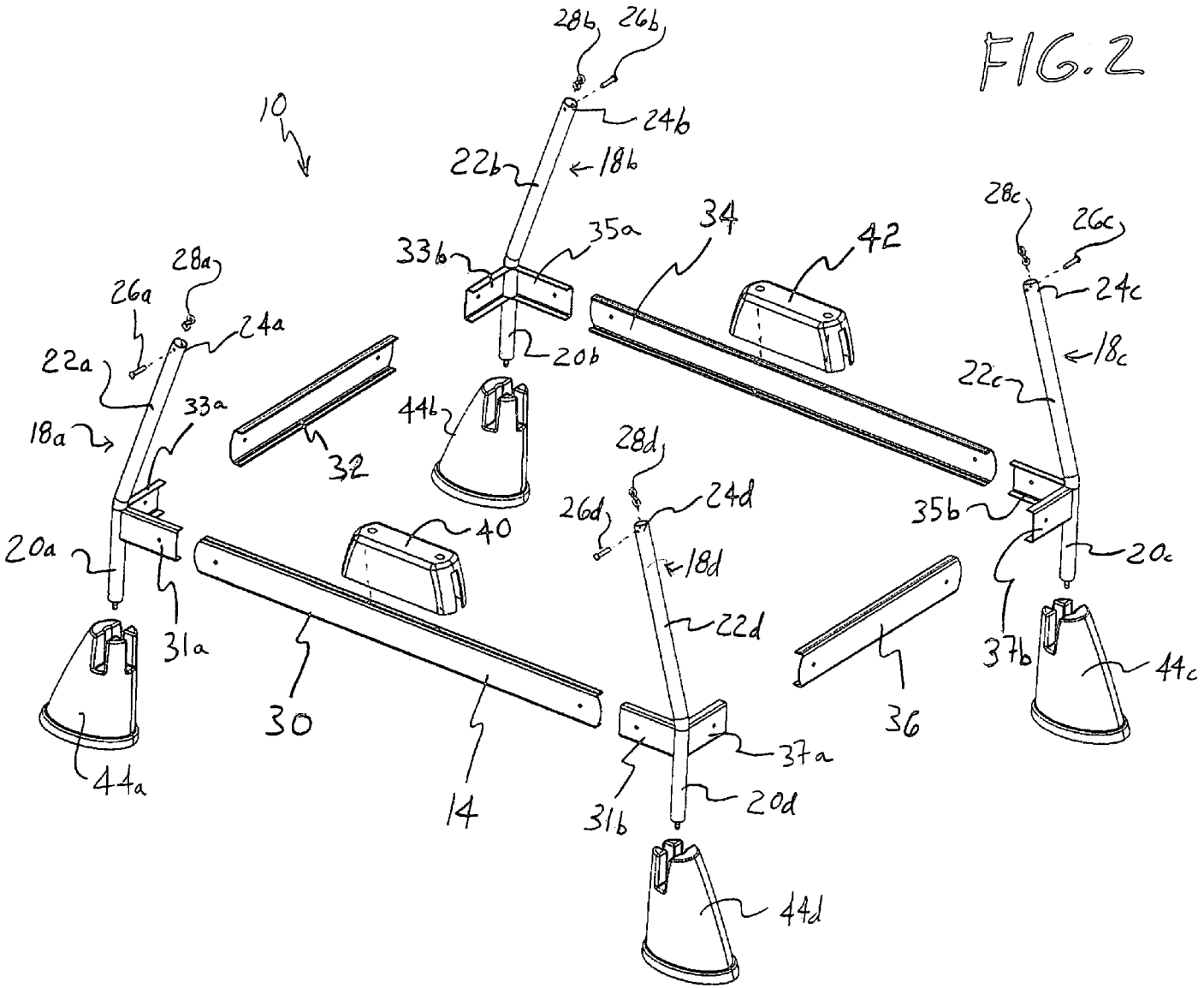
FIG. 2 is an exploded, perspective view of the rocking horse stand of FIG. 1.

As shown in FIGS. 1 and 2, a rocking horse 10 features a toy horse 12 that is suspended on a stand 14. The horse 12 is connected to the stand by four resilient members 16*a-d* such as coil or helical springs. While a toy horse is illustrated in the figures and described below, it will be understood that the invention is not limited to a toy horse but encompasses to any toy that holds a child sitting upon the toy, as long as the toy can be suspended from the stand 14.

The stand 14 has four tubular members, columns or legs indicated at 18*a-d* in FIG. 1 and in general at 18*a-d* in FIG. 2. As illustrated in FIG. 2, each leg 18*a-d* is formed with a lower section 20*a-d* connected to an inwardly bent upper section 22*a-d*. The upper sections 22*a-d* each have a top end 24*a-d* holding a pin 26*a-d*, which in turn is hooked to an S-shaped hook 28*a-d* for connection to the resilient members 16*a-d*. The legs 18*a-d* are connected to each other by four braces 30, 32, 34, and 36 extending from adjacent leg to adjacent leg.

While many ways exist to connect the braces 30, 32, 34 and 36 to the legs 18*a-d*, in the illustrated embodiment, as shown in FIG. 2, each brace 30, 32, 34 and 36 preferably has a C-shaped cross-section and bridges corner brace pieces 31*a-b*, 33*a-b*, 35*a-b* and 37*a-b*, which also feature C-shaped cross-sections. Each leg 18*a-d* is welded, integrally formed with, or otherwise fixed in any other suitable manner to two of the corner brace pieces 31*a-b*, 33*a-b*, 35*a-b*, 37*a-b*, which are positioned at 90 degrees relative to each other as best shown on FIG. 3. The corner brace pieces 31*a-b*, 33*a-b*, 35*a-b* and 37*a-b* extend from the lower sections 22*a-d* just below the bend in the legs 18*a-d*.

Figure 3:
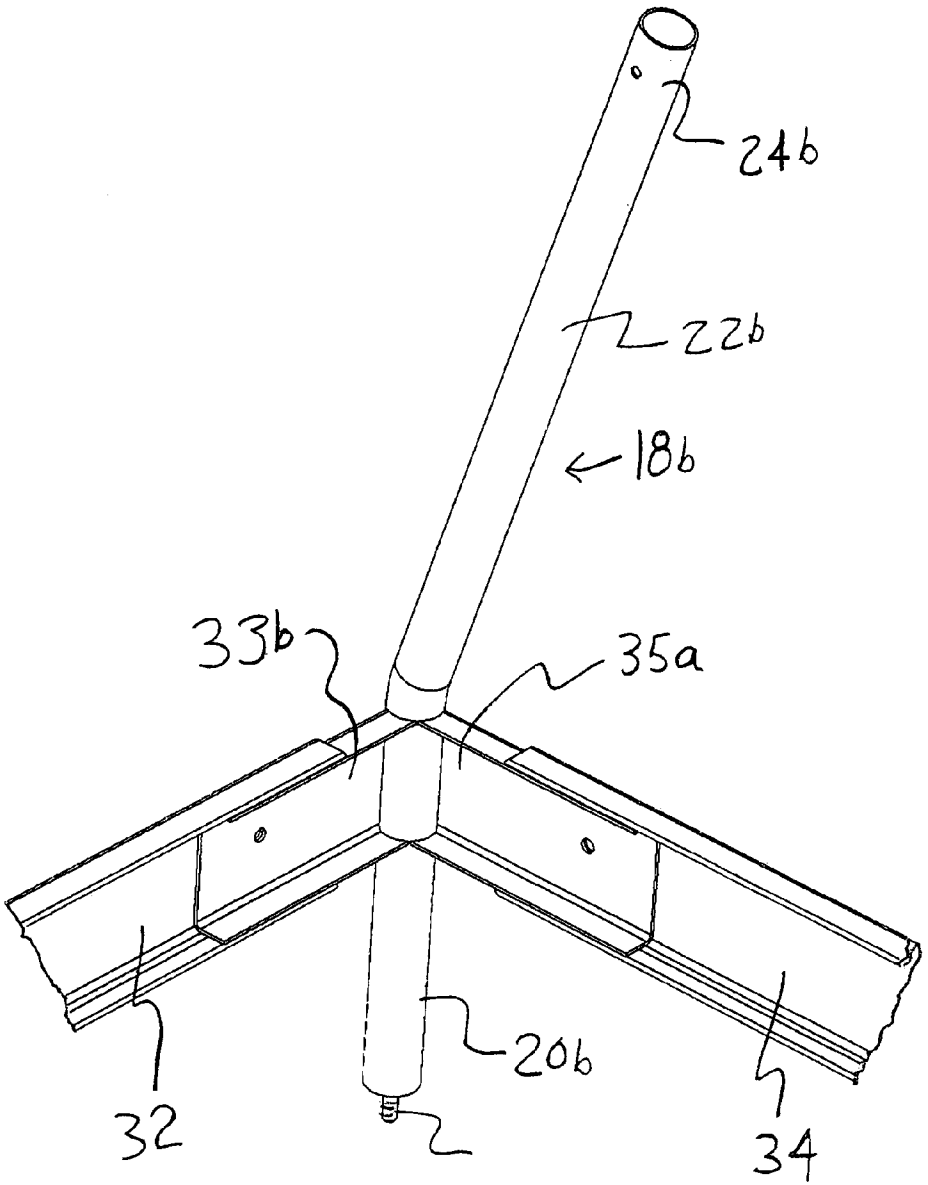
FIGS. 3 and 4 are enlarged, partial perspective views of the back-right corner of the rocking horse stand of FIG. 1 without and with the foot installed, respectively.

As illustrated in FIG. 3 for leg 18*b*, the braces 32 and 34 are slightly taller than the corner pieces 33*b* and 35*a* so that the corner pieces fit, and are nested, within the interior sides of the main beams. Legs 18*a*, 18*c* and 18*d* feature a similar arrangement. The braces 30, 32, 34 and 36 are connected to the corner pieces 31*a-b*, 33*a-b*, 35*a-b* and 37*a-b* by any suitable fastener, adhesive, welding or by other method. As illustrated in FIGS. 1 and 2, the stand 14 also provides steps 40, 42 fastened to the top flanges of the braces 30 and 34.

Figure 4:
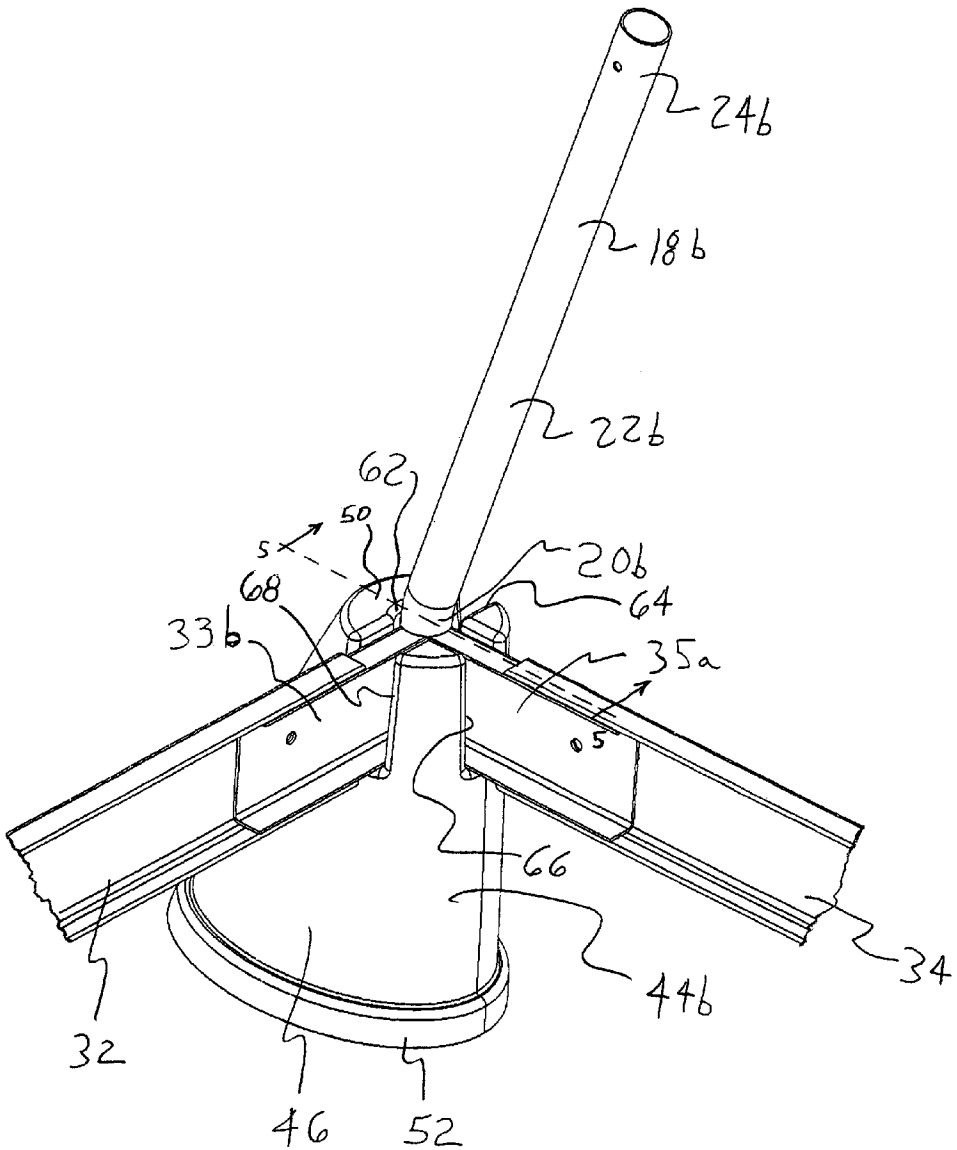
Figure 6:
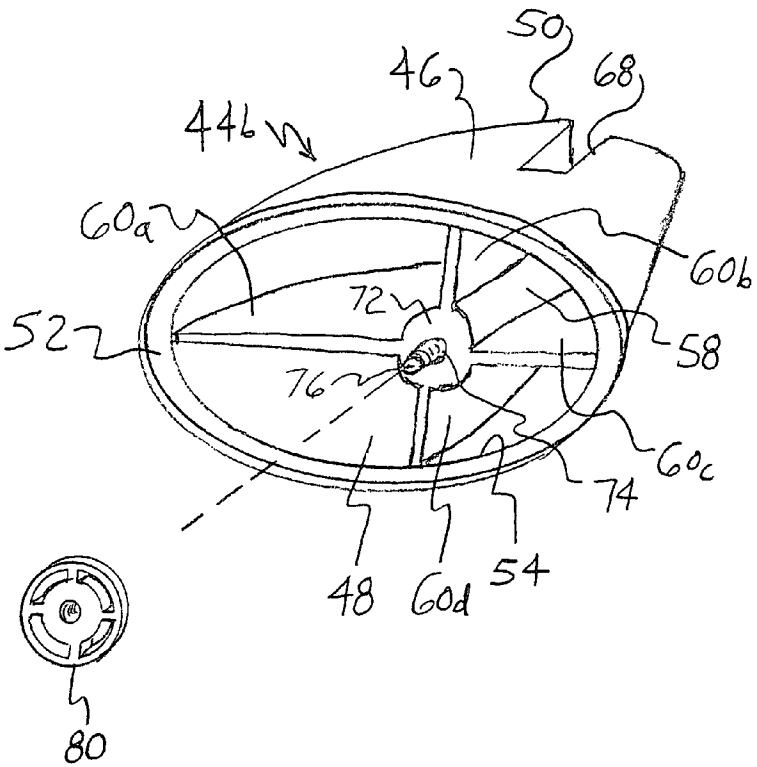
FIG. 6 is a bottom and side perspective view of the foot of FIGS. 4 and 5 illustrating the installation of the base nut.
Figure 5:
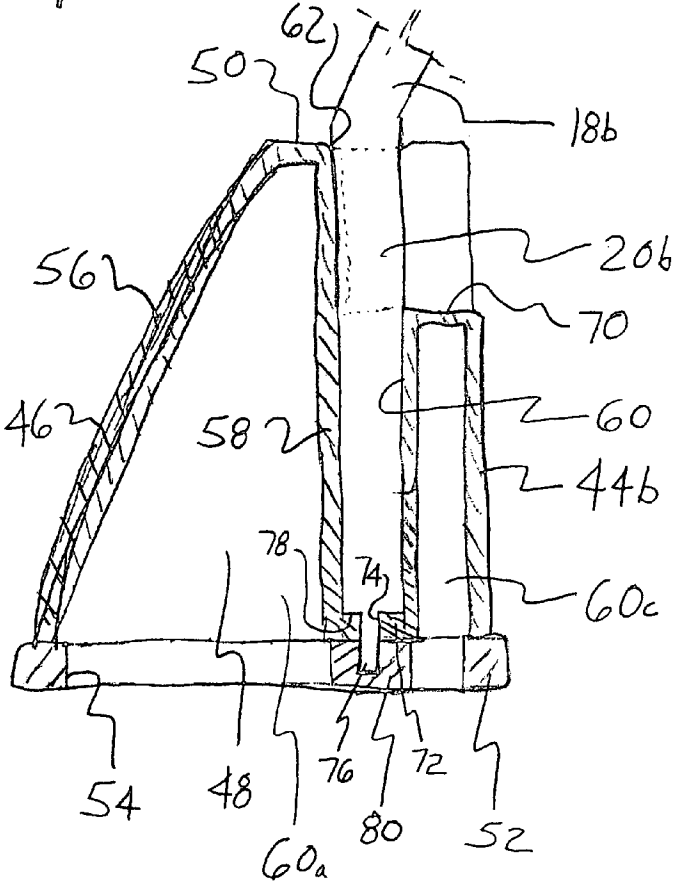
FIG. 5 is a cross-sectional view of the foot of the rocking horse stand taken along line 5-5 of FIG. 4.

Feet 44*a-d* are attached to the bottom sections 22*a-d* of the legs 18*a-d* as shown in FIGS. 1-2. Foot 44*b* is shown in FIGS. 4-6 but the other feet 44*a*, 44*c* and 44*d* are similar. Foot 44*b* has a generally cylindrical outer wall 46 defining an interior 48 and generally extending from a top end 50 to a bottom rim 52. Bottom rim 52 defines an opening 54 to the interior 48. The outer wall 46 has a generally oval frusto-conical shape such that widens from the top end 50 of the foot toward the bottom rim 52 of the foot. As a result, the foot provides a stable structure (i.e. is more difficult to tip)

by using a widened foot print and generally takes the shape of a horse's hoof for aesthetic enhancement.

As illustrated in FIGS. 5 and 6, the foot 44*b* also has an interior, cylindrical sidewall 58 defining a bore or pocket 60 with an opening 62 in a vicinity of the top end 50 for receiving the bottom section 20*b* of the leg 18*b* as shown in FIGS. 5-6. The interior sidewall 58 extends downward through the interior 48 of the foot 44*b* to just above the bottom rim 52. Four support walls 60*a-d* extend from the interior sidewall 58 to the outer wall 46 to provide extra lateral strength.

As illustrated in FIG. 4, slots 64, 66 and 68 communicate with the pocket 60. Each slot extends downward from top end 50 and slots 66 and 68 receive corner brace pieces 35*a* and 33*b*. The remaining legs 18*a*, 18*c* and 18*d* feature a similar arrangement. The foot has three slots so that it may be connected to any corner of the stand 14 and therefore accommodate the corner pieces that extend from the left or right of the foot. The corner pieces each rest on an interior bottom wall 70 of the foot defining the bottom of the slots.

A circular bottom wall 72 plugs the bottom of the sidewall 58 except for a small hole 74 that receives a threaded rod, pin or projection 76 extending downward from the bottom of leg 18*b*. The pin 76 is either integrally formed with the bottom of leg 18*b* or is otherwise connected or formed with a plug (not shown) that fits in the bottom end of the leg 18*b* and is connected by adhesives, welding or other connection arrangements.

The leg 18*b* has a bottom end 78 facing the bottom wall 72. A clamping device, such as a locking base nut 80, is threaded to the pin 76 on the exterior side of the bottom wall 72 which traps the bottom wall 72 between the bottom end 78 of the leg and the base nut 80. The base nut 80 is sufficiently thick enough to touch the floor to act as an independent base for the leg 18*b* and interior sidewall 58 separate from the outer rim 52 that is supporting the outer wall 46.

It will be appreciated that the invention alternatively includes any device that can lock the bottom section 20*a-d* of the legs 18*a-d* to the interior sidewall 58 instead of the pin 76 and locking base nut 80.

While the feet 44 are manufactured as a single molded plastic piece, except for the base nuts 80, 82, it will be appreciated that the use of other materials (such as wood or metals) and manufacturing methods are possible.

While some of the embodiments of the invention have been shown and described, it will be apparent to those skilled in the art that changes and modifications may be made therein without departing from the spirit of the invention, the scope of which is defined by the appended claims.

What is claimed is:

1. A rocking toy stand comprising:

a) a plurality of legs each with a top end and a bottom end;

b) at least one foot having:

i. a top end, ii. a bottom rim, iii. an outer wall defining an interior and generally extending from said top end to said bottom rim, iv. an interior sidewall defining a pocket with an opening in a vicinity of said top end for receiving one of said bottom ends of one of said legs within said pocket, and v. at least three slots cominunicating with said pocket so that any said foot can be placed at any corner on said rocking horse stand; and c) each of said top ends of said legs adapted to suspend the rocking toy.

2. The rocking toy stand of claim 1, wherein said stand has a plurality of brace members, at least one of said brace members extending between a pair of said plurality of legs.

3. The rocking toy stand of claim 1, wherein said outer wall widens toward said bottom rim of said foot.

4. The rocking toy stand of claim 1, wherein said foot is molded from plastic.

5. The rocking toy stand of claim 1, wherein said outer wall is generally frusto-conical shape.

6. The rocking toy stand of claim 5, wherein said outer wall is in a generally oval frusto-conical shape.

7. The rocking toy stand of claim 1, wherein said interior sidewall extends a majority of a total height of said foot.

8. The rocking toy stand of claim 1, further comprising means for securing said leg to said interior sidewall.

9. The rocking toy stand of claim 8, wherein said pocket has a bottom wall, and wherein said leg has a bottom end facing said bottom wall, said means for securing connecting said bottom end of said leg to said bottom wall.

10. The rocking toy stand of claim 9, wherein said means of securing further includes an aperture formed in said bottom wall and said bottom end having an extension passing trough said aperture, and a clamping device for trapping said bottom wall between said bottom end of said leg and said clamping device.

11. The rocking toy stand of claim 10, wherein said clamping device is a base nut threaded to said extension on an exterior side of said bottom wall relative to said leg.

12. The rocking toy stand of claim 11, wherein said bottom rim is a base that Is adapted to rest on a floor and wherein said base nut is sufficiently thick to act as a base sitting on a floor for said leg and said interior wall that is separate from said bottom rim.

13. A rocking toy stand comprising:

a) a plurality of legs each with a top end and a bottom end, each of said top ends of said legs adapted to suspend the rocking toy;

b) at least one foot having:

i. atop end, ii. a bottom rim, iii. an outer wall defining an interior and generally extending from said top end to said bottom rim, and iv. an interior sidewall defining a pocket with an opening in a vicinity of said top end for receiving one of said bottom ends of one of said legs within said pocket; and c) a plurality of brace members secured one each between a pair of the plurality of legs by corner pieces that are connected to each of said plurality of legs and wherein said top of said foot defines slots for receiving the corner pieces.

14. A foot for a rocking toy stand where the toy is suspended from a stand and the stand includes a plurality of legs with each leg having a top end and bottom end and a plurality of brace members extending between the legs, the foot comprising:

a top end;

a bottom rim;

an outer wall generally extending from said top end to said bottom rim and defining an interior of said foot;

an interior sidewall extending downward within said interior of said foot and from said top end and defining a pocket with an opening at said top end for receiving one said bottom end of one of said legs; and a plurality of slots formed in the top end and adapted to receive brace members secured between the plurality of less of the stand.

15. The foot of claim 14, wherein said foot is molded from plastic.

16. A foot for a rocking toy stand where the toy is suspended from a stand and the stand includes a plurality of legs with each leg having a top end and bottom end and a plurality of brace members extending between the legs, the foot comprising:

a top end;

a bottom rim;

an interior sidewall extending downward within said foot and from said top end, and defining a pocket with an opening at said top end for receiving one said bottom end of one of said legs;

a bottom wall extending from said sidewall and facing said bottom end of said leg; and a base nut connected to said leg through said bottom wall for securing said leg to said foot.

17. The foot of claim 16, wherein said base nut is configured for touching the ground and supporting said leg and said interior sidewall.

18. The foot of claim 16 further comprising a plurality of slots formed in the top end and adapted to receive brace members secured between the plurality of legs of the stand.

* * * * *